US008851626B2

(12) United States Patent
Suwada

(10) Patent No.: US 8,851,626 B2
(45) Date of Patent: Oct. 7, 2014

(54) CAP DEVICE AND INK JET PRINTER

(71) Applicant: Roland DG Corporation, Hamamatsu (JP)

(72) Inventor: Akira Suwada, Hamamatsu (JP)

(73) Assignee: Roland DG Corporation, Shizuoka (JP)

( * ) Notice: Subject to any disclaimer, the term of this patent is extended or adjusted under 35 U.S.C. 154(b) by 0 days.

(21) Appl. No.: 14/105,505

(22) Filed: Dec. 13, 2013

(65) Prior Publication Data

US 2014/0168316 A1 Jun. 19, 2014

(30) Foreign Application Priority Data

Dec. 14, 2012 (JP) ..... 2012-273383

(51) Int. Cl.
*B41J 2/165* (2006.01)

(52) U.S. Cl.
CPC ..... *B41J 2/16511* (2013.01)
USPC ..... 347/29; 347/32

(58) Field of Classification Search
USPC ..... 347/29, 32
See application file for complete search history.

(56) References Cited

U.S. PATENT DOCUMENTS

| | | | | |
|---|---|---|---|---|
| 2003/0071870 | A1 | 4/2003 | Murcia et al. | |
| 2009/0033707 | A1* | 2/2009 | Shimazaki | 347/29 |
| 2013/0050333 | A1* | 2/2013 | Tanaka et al. | 347/29 |

FOREIGN PATENT DOCUMENTS

| | | | |
|---|---|---|---|
| JP | 08-216390 | A | 8/1996 |
| JP | 08-219014 | A | 8/1996 |
| JP | 2000-255075 | A | 9/2000 |
| JP | 2003-127407 | A | 5/2003 |

* cited by examiner

*Primary Examiner* — Jason Uhlenhake
(74) *Attorney, Agent, or Firm* — Keating & Bennett, LLP

(57) ABSTRACT

A cap device includes a first table provided so as not to be movable in a main scanning direction with respect to a base member; a first cap provided on the first table; a first guide member which has a first contact surface directed leftward and is provided on the first table; a second table provided so as to be movable in the main scanning direction with respect to the base member; a second cap provided on the second table; a second guide member which has a second contact surface directed leftward and is provided on the second table; a third guide member which has a third contact surface facing the first contact surface and is provided on a first ink head unit; and a fourth guide member which has a fourth contact surface facing the second contact surface and is provided on a second ink head unit. The first, second, third and fourth guide members are located such that when a carriage moves rightward, the second contact surface and the fourth contact surface contact each other and after this, the first contact surface and the third contact surface contact each other.

8 Claims, 11 Drawing Sheets

CAP DEVICE AND INK JET PRINTER

The present application claims priority from Japanese Patent Application No. 2012-273383 filed on Dec. 14, 2012, which is incorporated by reference herein in its entirety.

BACKGROUND OF THE INVENTION

1. Field of the Invention

The present invention relates to a cap device and an inkjet printer.

2. Description of the Related Art

Conventionally, inkjet printers for performing printing by an inkjet method are known. Such an inkjet printer, for example, performs printing on a recording paper sheet supplied by a paper feeding device. The inkjet printer includes a carriage having an ink head unit mounted thereon. The carriage moves above the recording paper sheet in a width direction of the recording paper sheet. (In this specification, the width direction of a medium such as a recording paper sheet or the like will be referred to as a "main scanning direction". A direction perpendicular to the main scanning direction will be referred to as a "sub scanning direction".) The inkjet printer, for example, has an overall operation thereof controlled by a microcomputer.

As shown in, for example, FIGS. 11*a* and 11*b*, in such an inkjet printer, a carriage 100 movable in the main scanning direction may have a plurality of ink head units 101 mounted thereon. Provision of the plurality of ink head units 101 shortens the time required for printing. Each of the ink head units 101 has a plurality of inkjet nozzles (not shown) formed on a bottom surface thereof. The inkjet nozzles are each an ejection orifice for ejecting ink to a medium such as a recording paper sheet or the like. The ink head units 101 are located above the medium during printing, and are located at a wait position after, for example, the printing on the medium is finished.

The inkjet printer includes a cap device for capping the bottom surfaces of the ink head units 101 at the wait position. The cap device is located below the ink head units 101 at the wait position.

Such a cap device includes a cap formed of a flexible material such as rubber or the like. The cap is closely contactable with a bottom surface of an ink head unit having inkjet nozzles formed thereon. The cap protects the bottom surface of the ink head unit. Since the bottom surface of the ink head unit is protected by the cap, the inkjet nozzles is protected against dust or the like. The cap device has an element for discharging thickened ink or air bubbles in the ink from the inkjet nozzles. This prevents clogging of the inkjet nozzles and incorporation of air bubbles into the ink in the inkjet nozzles.

When the ink head unit is moved to the wait position at a prescribed timing, for example, after the finish of the printing, the cap in the cap device is raised to closely contact the bottom surface of the ink head unit. In this state, the cap forms a hermetically closed space around the inkjet nozzles of the ink head unit. After this, a suction device connected to the cap device sucks the air in the hermetically closed space. As a result, the pressure in the hermetically closed space becomes a negative pressure, and thus the ink and the air bubbles are discharged from the inkjet nozzles.

In order to perform the above-described operation properly, the cap device needs to be positioned accurately with respect to the ink head unit which is at the wait position. When the ink head unit is located at the wait position, the cap and the bottom surface of the ink head unit need to closely contact each other to form a hermetically closed space around the inkjet nozzles. In the case where a plurality of ink head units are mounted on the carriage, caps are located in positional correspondence with the ink head units, respectively. Namely, the caps are located so as to form hermetically closed spaces around the inkjet nozzles in the ink head units, respectively.

Conventionally, a cap device including a plurality of caps is designed and produced as follows. First, the position of, for example, a leftmost ink head unit, among the plurality of ink head units mounted on the carriage, is determined. Next, the positions of the other ink head units are determined based on the position of the leftmost ink head unit. In the meantime, the positions of the plurality of caps on a base member, which is a base portion of the cap device, are determined. First, the position of a leftmost cap is determined. Next, the positions of the other caps are determined based on the position of the leftmost cap. Then, the position of the cap device with respect to the carriage is determined. More specifically, the position of the cap device is determined such that when the carriage is at the wait position, the leftmost cap is located in positional correspondence with the leftmost ink head unit.

During the production of an inkjet printer, the ink head units are located on the carriage, at the positions determined as described. The caps are located on the base member of the cap device, at the positions determined as described above. The cap device is located at the position determined as described above.

However, this technique causes the following situation. When, for example, the size of components or the like is varied, an error occurs to the positions of the caps other than the cap used as the reference, with respect to the ink head units other than the ink head unit used as the reference. In the above-described example, an error occurs to the positions of the caps other than the leftmost cap, with respect to the ink head units other than the ink head unit corresponding to the leftmost cap.

Therefore, the positions of the caps need to be adjusted when the cap device is assembled, which has been pointed out as a problem. A known technique for solving this problem is disclosed in, for example, Japanese Laid-Open Patent Publication No. 2000-255075.

Japanese Laid-Open Patent Publication No. 2000-255075 discloses a cap unit slidable in the sub scanning direction with respect to a cap unit mounting section and a guide claw located away from the cap unit by a prescribed distance in the sub scanning direction. Japanese Laid-Open Patent Publication No. 2000-255075 describes that even when the cap unit is positionally diverged in the sub scanning direction with respect to a recording head, the cap unit is guided by the guide claw in the sub scanning direction while being raised, and thus the position of the cap unit in the sub scanning direction with respect to the recording head can be corrected.

However, the technique described in Japanese Laid-Open Patent Publication No. 2000-255075 merely corrects the position of the cap unit in the sub scanning direction with respect to the recording head, but cannot correct the position of the cap unit in the main scanning direction Y with respect to the recording head. Therefore, the cap unit cannot be always put into close contact with an appropriate position in the recording head. For example, there are cases where the cap unit cannot form a hermetically closed space around the recording head nozzle.

For this reason, even the cap device including such a position adjusting mechanism disclosed in Japanese Laid-Open Patent Publication No. 2000-255075 does not sufficiently function in an inkjet printer including a plurality of ink head units, and has been pointed out as having problems such as clogging of the inkjet nozzles and incorporation of air bubbles.

In such a situation, a cap device which includes a plurality of caps for performing capping for a plurality of ink head units, and is capable of correcting the position of at least one cap in the main scanning direction, is strongly desired. An inkjet printer including such a cap device is also desired.

SUMMARY OF THE INVENTION

The present invention has an object of providing a cap device which includes a plurality of caps and is capable of correcting the position of at least one cap in the main scanning direction.

The present invention has another object of providing an inkjet printer including such a cap device.

A cap device according to the present invention is provided in an inkjet printer. The inkjet printer includes a carriage movable in a main scanning direction between a printing position and a wait position; a first ink head unit having a bottom surface on which an inkjet nozzle is provided, the first ink head unit being mounted on the carriage; and a second ink head unit having a bottom surface on which an inkjet nozzle is provided, the second ink head unit being mounted on the carriage. The device includes a base member; a first table provided so as not to be movable in the main scanning direction with respect to the base member; a first cap provided on the first table, the first cap being closely contactable with the bottom surface of the first ink head unit by being raised; a first guide member which has a first contact surface directed in a second direction, and is provided on the first table, where a direction in the main scanning direction that approaches the wait position is a first direction and a direction in the main scanning direction that is distanced from the wait position is the second direction; a second table provided so as to be movable in the main scanning direction with respect to the base member; a second cap provided on the second table, the second cap being closely contactable with the bottom surface of the second ink head unit by being raised; a second guide member which has a second contact surface located on the side of the first direction with respect to the first contact surface and directed in the second direction, and is provided on the second table; a third guide member which has a third contact surface facing the first contact surface, is provided on the first ink head unit, and protrudes downward from the carriage; and a fourth guide member which has a fourth contact surface located on the side of the first direction with respect to the third contact surface and facing the second contact surface, is provided on the second ink head unit, and protrudes downward from the carriage. The first, second, third and fourth guide members are arranged such that when the carriage moves in the first direction, the second contact surface and the fourth contact surface contact each other and after this, the first contact surface and the third contact surface contact each other.

In this specification, the term "medium" encompasses various types of recording mediums formed of plain paper and other types of paper and also recording mediums formed of various types of materials including PVC, resin materials such as polyester and the like, and other materials including aluminum, iron, wood and the like.

In this specification, the term "inkjet method" refers to any of various, conventionally known printing methods using inkjet technology that include various continuous methods such as a binary deflection method and a continuous deflection method and various on-demand methods such as a thermal method and a piezoelectric element method.

DETAILED DESCRIPTION OF THE PREFERRED EMBODIMENTS

Hereinafter, a cap device and an inkjet printer in an embodiment of the present invention will be described with reference to the attached drawings.

Figure 1:
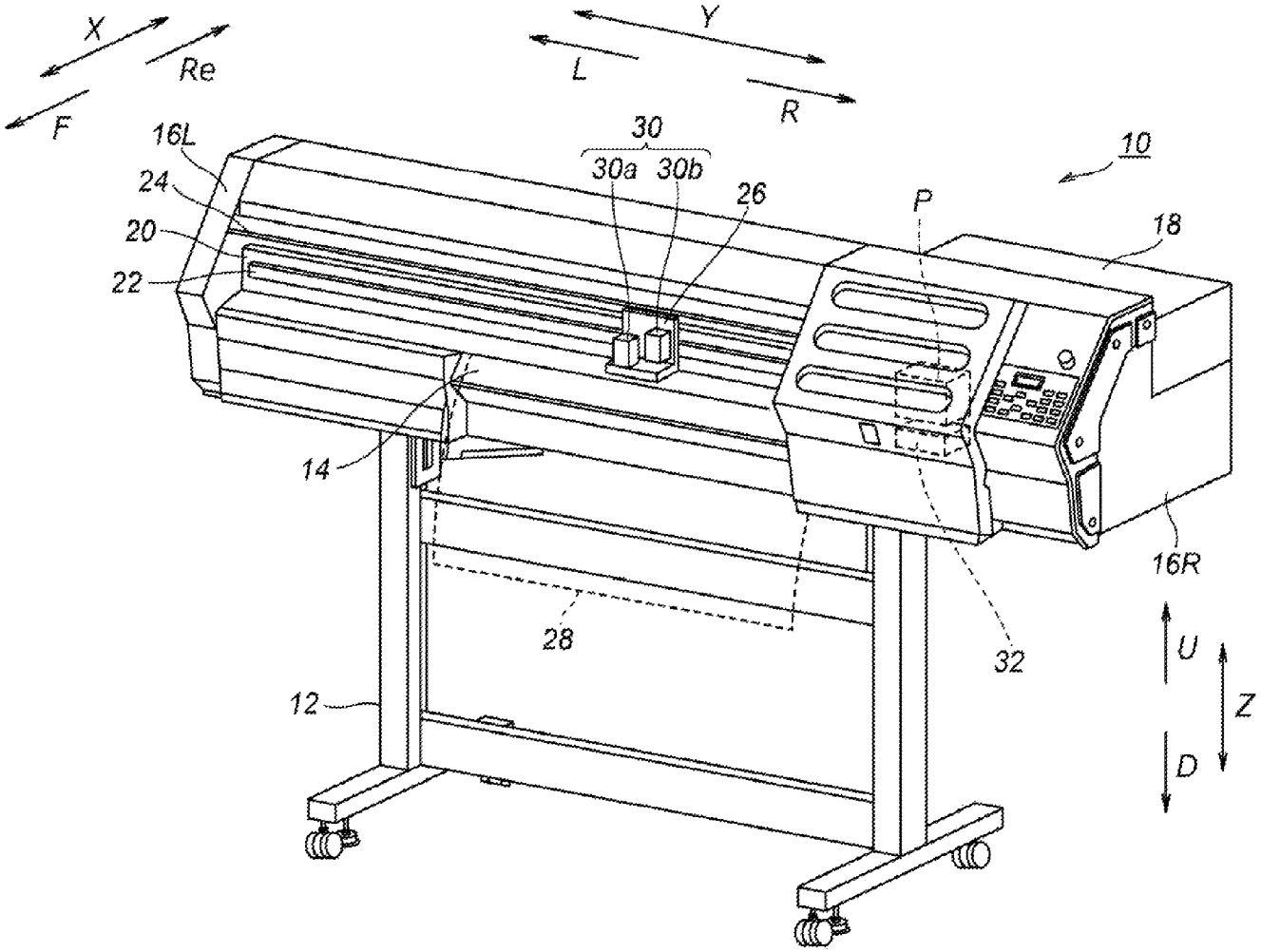
FIG. 1 is an isometric view of an inkjet printer.

FIG. 1 shows a schematic structure of an inkjet printer 10 including a cap device 32 in this embodiment. In the following description, the terms "left", "right", "up" and "down" respectively mean left, right, up and down as seen from a user who is facing the inkjet printer 10 in front thereof. A direction approaching the user from the inkjet printer 10 is defined as "forward", and a direction moving away from the user toward the inkjet printer 10 is defined as "rearward". In the figures, reference signs F, Re, L, R, U and D respectively represent forward, rearward, leftward, rightward, upward and downward. In the figures, reference sign Y represents a main scanning direction. In this embodiment, the main scanning direction Y is the left-right direction. Reference sign X represents a sub scanning direction. The sub scanning direction X is perpendicular to the main scanning direction Y. In this embodiment, the sub scanning direction X is the front-rear direction. Reference sign Z represents the up-down direction. It should be noted that the above-described directions are defined for the sake of convenience and should not be interpreted as limiting the present invention.

The inkjet printer 10 includes a base member 14, side members 16L and 16R, a side unit 18, a central wall 20, a guide rail 22, a belt 24, a carriage 26, and an ink head section 30. The base member 14 extends in the main scanning direction Y and is supported by a support member 12. The left side member 16L is provided at a left end of the base member 14. The right side member 16R is provided at a right end of the base member 14. The side unit 18 is located to the rear of the right side member 16R. The central wall 20 extends in the main scanning direction Y and couples the left side member 16L and the right side member 16R to each other. The guide rail 22 is located on a wall surface of the central wall 20 and extends in the main scanning direction Y. The belt 24 is located parallel to the wall surface of the central wall 20 and extends in the main scanning direction Y. The carriage 26 is slidably mounted on the guide rail 22 and is fixed to the belt 24. When the belt 24 runs, the carriage 26 moves in the main scanning direction Y along the guide rail 22. Namely, the carriage 26 is movable leftward and rightward. A recording paper sheet 28, which is a medium, is located on the base member 14. Although not shown, the inject printer 10 includes a paper feeding roll around which the recording paper sheet 28 is to be wound and a paper feeding device for moving the recording paper sheet 28. The recording paper sheet 28 is fed onto the base member 14 from the paper feeding roll by the paper feeding device. The recording paper sheet 28 is fed in the sub scanning direction X. For example, at the time of printing, the recording paper sheet 28 is fed forward. The ink head section 30 is located on the carriage 26 and faces the recording paper sheet 28. The inkjet printer 10 includes a microcomputer (not shown) mounted on the side unit 18. The overall operation of the inkjet printer 10 is controlled by the microcomputer.

For the carriage 26 and the ink head section 30, a wait position P which is in the side unit 18 is defined in addition to a printing position. The printing position is a position where printing is performed on the recording paper sheet 28, and is above the recording paper sheet 28. The wait position P is to the right of the printing position. The wait position P may be to the left of the printing position. The wait position P is not limited to any particular position. When the carriage 26 and the ink head section 30 are at the wait position P, the printing on the recording paper sheet 28 is not performed. The carriage 26 moves to the wait position P at a prescribed timing, for example, when the printing is finished. When the carriage 26 is at the wait position P, the ink head section 30 mounted on the carriage 26 are also located at the wait position P. The cap device 32 is provided below the wait position P.

Figure 2A:
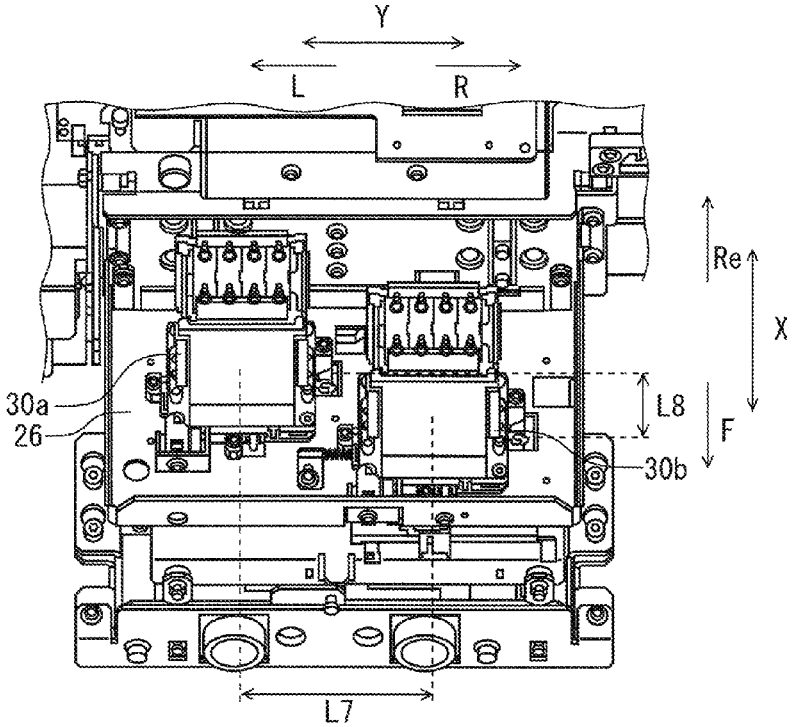
FIG. 2*a* is an isometric view of ink head units located on a carriage.

The ink head section 30 includes an ink head unit 30*a* and an ink head unit 30*b*. As shown in FIG. 2*a*, the ink head unit 30*a* and the ink head unit 30*b* are distanced from each other in the main scanning direction Y, and are shifted from each other in the sub scanning direction X. A front end of the ink head unit 30*a* is to the rear of a front end of the ink head unit 30*b*. A rear end of the ink head unit 30*a* is to the rear of a rear end of the ink head unit 30*b*. The ink head unit 30*a* is located on a left rear portion of the carriage 26, and the ink head unit 30*b* is located on a right front portion of the carriage 26.

Figure 2B:
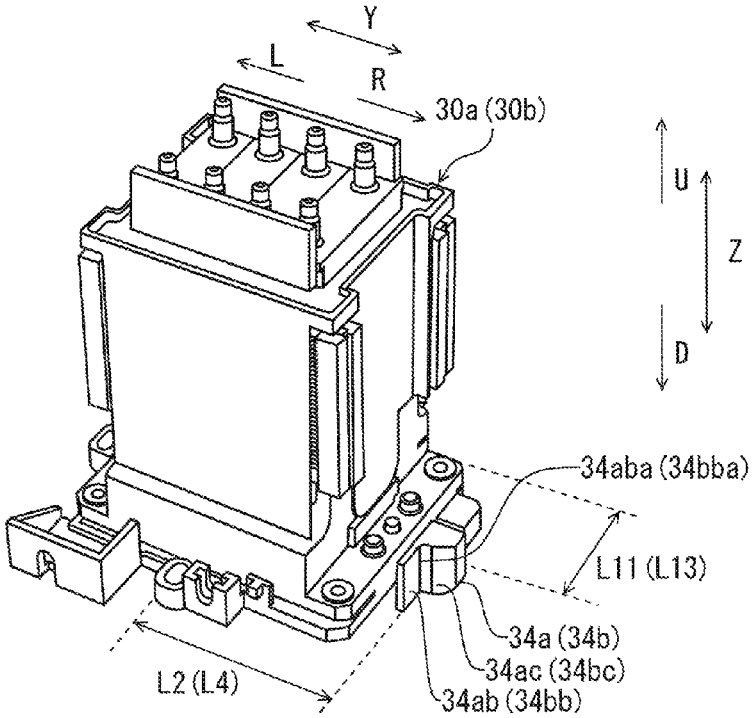
FIG. 2*b* is an isometric view of one of the ink head units.

FIG. 2*b* is an isometric view of the ink head unit 30*a*. In this embodiment, the ink head unit 30*a* and the ink head unit 30*b* have the same structure as each other. In FIG. 2*b*, reference signs representing elements of the ink head unit 30*b* are provided in parentheses. The ink head unit 30*a* and the ink head unit 30*b* may have different structures from each other.

As shown in FIG. 2*b*, a guide member 34*a* is provided to the right of the ink head unit 30*a*. The guide member 34*a* has guide surfaces 34*ab* and 34*ac*. The guide surfaces 34*ab* and 34*ac* are structured to contact a guide member 50 (see FIG. 5*a*) provided in a cap section 42 described later. The guide surface 34*ab* is formed parallel to the sub scanning direction X. The guide surface 34*ac* extends obliquely rightward and rearward from a rear end 34*aba* of the guide surface 34*ab*.

As shown in FIG. 2*b*, a guide member 34*b* is provided to the right of the ink head unit 30*b*. The guide member 34*b* has guide surfaces 34*bb* and 34*bc*. The guide surfaces 34*bb* and 34*bc* are structured to contact a guide member 60 (see FIG. 5*a*) provided in a cap section 44 described later. The guide surface 34*bb* is formed parallel to the sub scanning direction X. The guide surface 34*bc* extends obliquely rightward and rearward from a rear end 34*bba* of the guide surface 34*bb*.

Figure 3A:
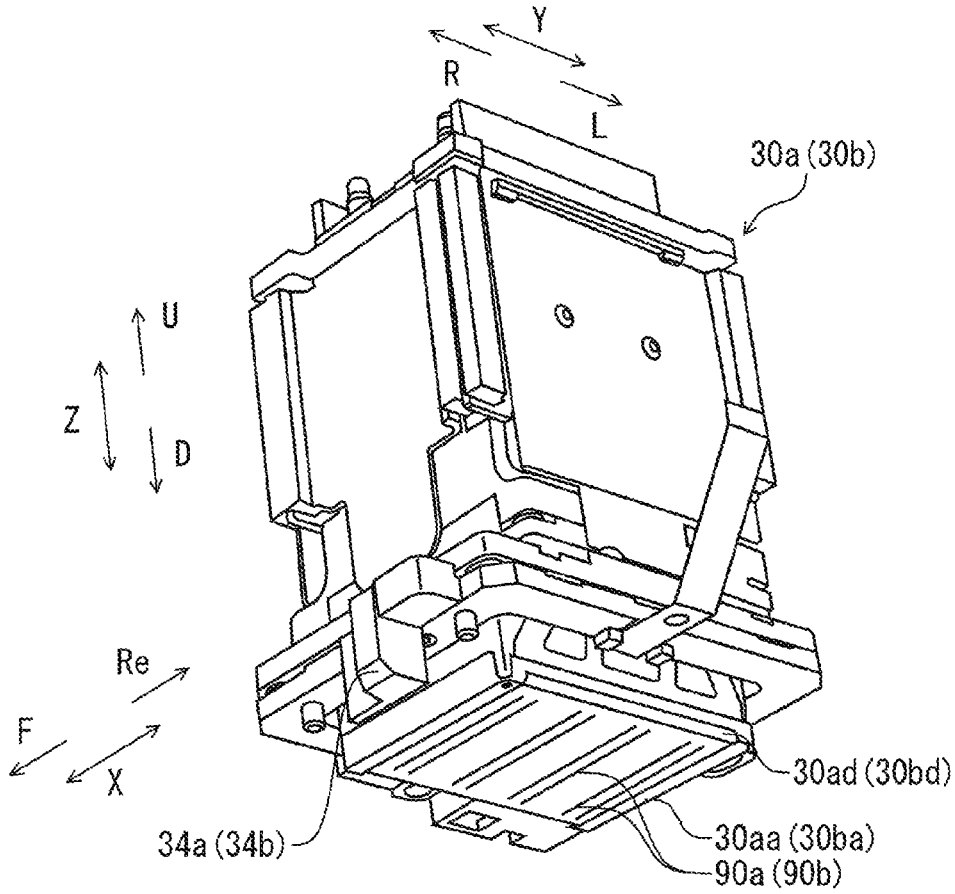
FIG. 3*a* is an isometric view of the ink head unit.
Figure 4:
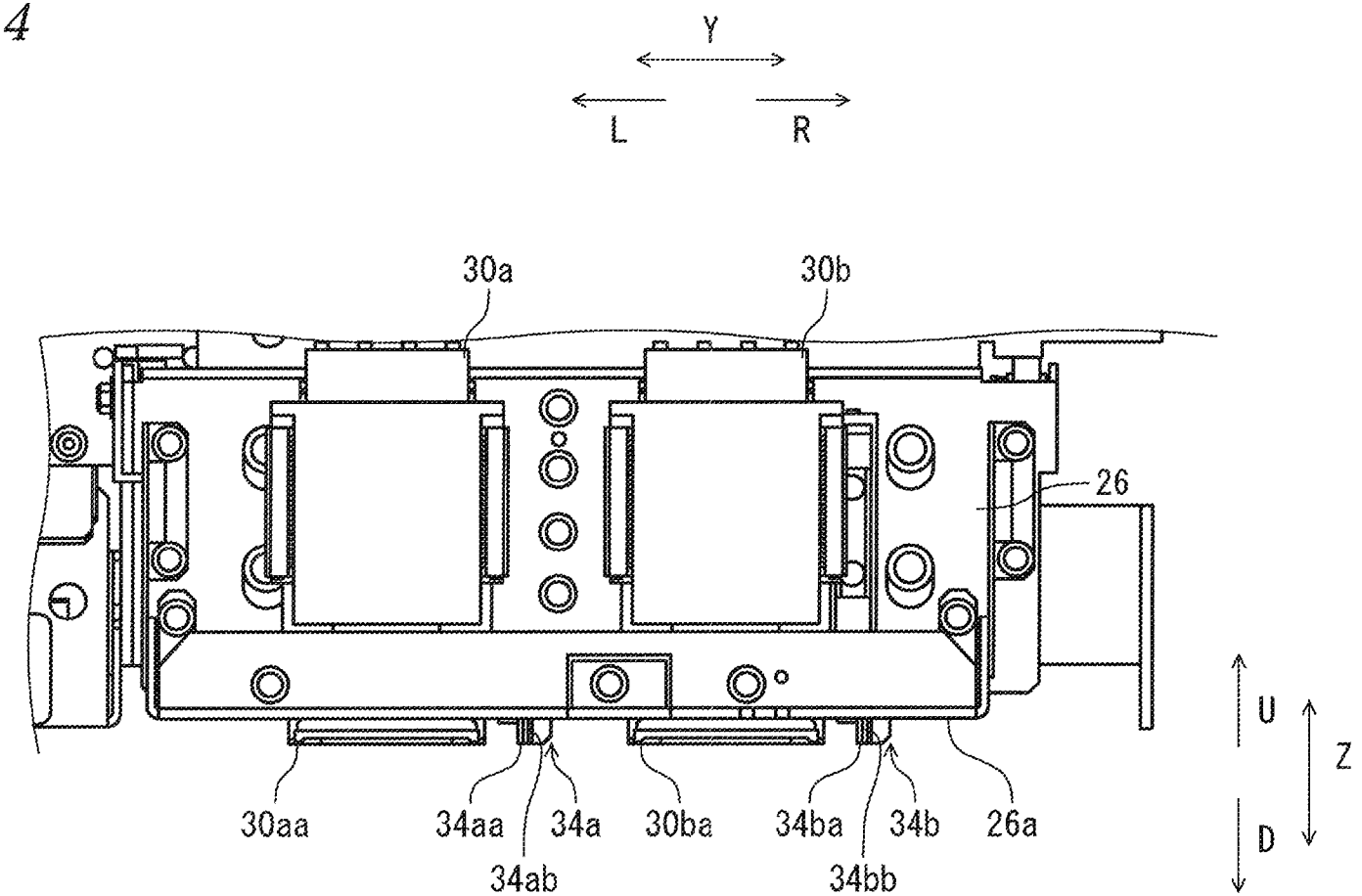
FIG. 4 is a front view of the ink head units located on the carriage.

As shown in FIG. 3*a*, the ink head unit 30*a* has a plurality of inkjet nozzles 90*a* provided on a bottom surface 30*aa* thereof. In this embodiment, the inkjet nozzles 90*a* are arranged in the sub scanning direction X and the main scanning direction Y. In FIG. 3*a*, lines of a plurality of inkjet nozzles 90*a* arranged in the sub scanning direction X are each represented with a straight line. As shown in FIG. 4, the ink head unit 30*a* is located on the carriage 26 such that the bottom surface 30*aa* and the guide member 34*a* are below a bottom surface 26*a* of the carriage 26. The bottom surface 30*aa* and a bottom surface 34*aa* of the guide member 34*a* are at substantially the same level.

As shown in FIG. 3*a*, the ink head unit 30*b* has a plurality of inkjet nozzles 90*b* provided on a bottom surface 30*ba* thereof. In this embodiment, the inkjet nozzles 90*b* are arranged in the sub scanning direction X and the main scanning direction Y. In FIG. 3*a*, lines of a plurality of inkjet nozzles 90*b* arranged in the sub scanning direction X are each represented with a straight line. As shown in FIG. 4, the ink head unit 30*b* is located on the carriage 26 such that the bottom surface 30*ba* and the guide member 34*b* are below the bottom surface 26*a* of the carriage 26. The bottom surface 30*ba* and a bottom surface 34*ba* of the guide member 34*b* are at substantially the same level. The bottom surface 30*aa* of the ink head unit 30*a*, the bottom surface 34*aa* of the guide member 34*a*, the bottom surface 30*ba* of the ink head unit 30*b*, and the bottom surface 34*ba* of the guide member 34*b* are at substantially the same level.

Figure 5A:
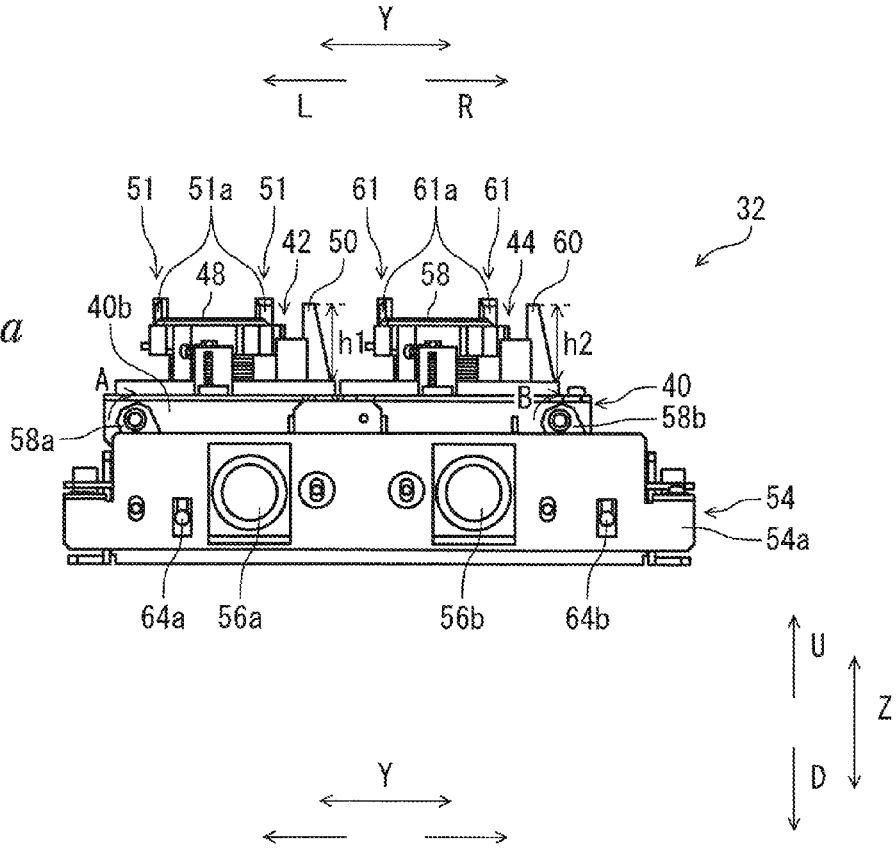
FIG. 5*a* is a front view of a cap device in the state where a base member is at a lowermost position.
Figure 5B:
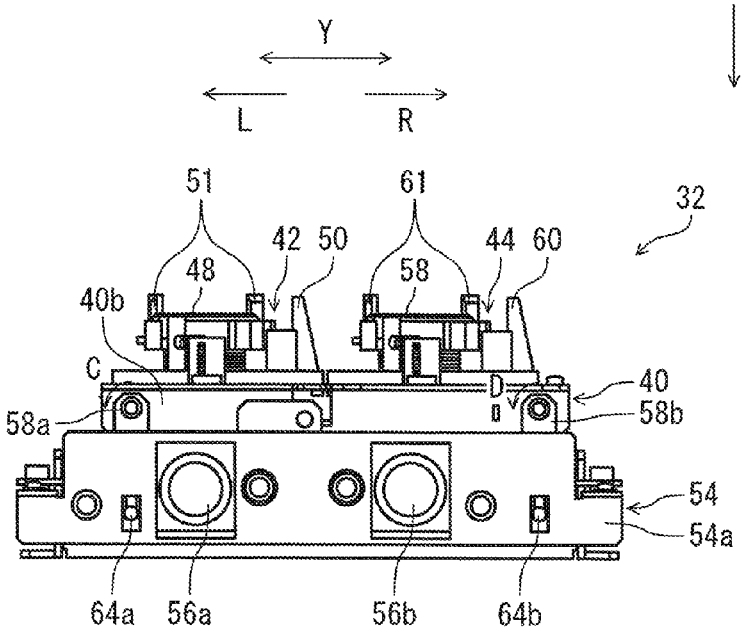
FIG. 5*b* is a front view of the cap device in the state where the base member is at an uppermost position.
Figure 6A:
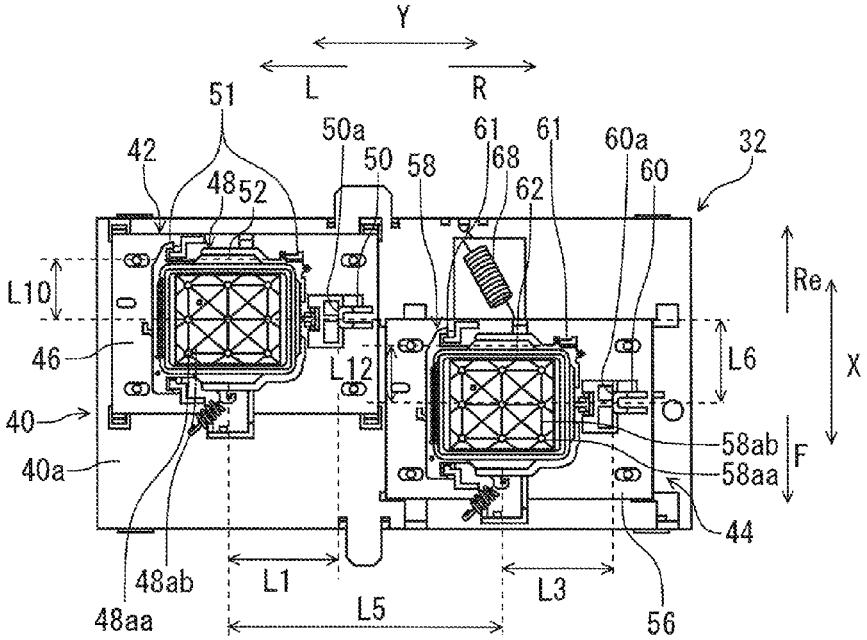
FIG. 6*a* is a plan view of cap sections located on the base member.
Figure 6B:
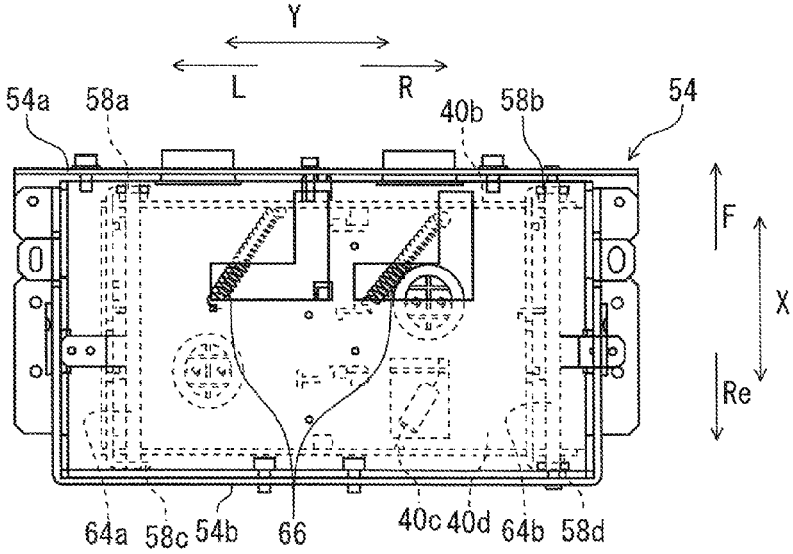
FIG. 6*b* is a bottom view of the cap device.

As shown in FIG. 5*a* and FIG. 5*b*, the cap device 32 includes a base support member 54, a base member 40 provided on the base support member 54 so as to be movable upward and downward, and the cap sections 42 and 44 provided on the base member 40. The base support member 54 is located below the wait position P in the side unit 18. As shown in FIG. 6*a* and FIG. 6*b*, the base member 40 has a length in the sub scanning direction X that is set to be shorter than a length of the base support member 54 in the sub scanning direction X. The cap section 42 is located on a left rear portion of a top surface 40*a* of the base member 40. The cap section 44 is located on a right front portion of the top surface 40*a* of the base member 40.

As shown in FIG. 5*a* and FIG. 5*b*, the base support member 54 has openings 56*a* and 56*b* in a front wall 54*a* thereof. The opening 56*a* is in connection with the cap section 42, and is connectable with a tube which is connected to a suction device (not shown). The opening 56*b* is in connection with the cap section 44, and is connectable with another tube which is connected to another suction device (not shown).

As shown in FIG. 6*a*, the cap section 42 includes a plate-like member 46, a cap 48 fixed to the plate-like member 46, and the guide member 50 standing on the plate-like member 46. The guide member 50 is located to the right of the cap 48. The plate-like member 46 is located on a left rear portion of the top surface 40*a* of the base member 40. The plate-like member 46 is structured so as to be movable in the sub scanning direction X but so as not to be movable in the main scanning direction Y.

The cap 48 is positioned such that when the base member 40 is raised, the cap 48 can contact the bottom surface 30*aa* of the ink head unit 30*a* to form a hermetically closed space around the inkjet nozzles 90*a* in the ink head unit 30*a*. The cap 48 includes a flexible member 52 provided in a top portion thereof. The flexible member 52 is formed of a flexible material such as rubber or the like. The flexible member 52 is located such that an outer profile and an inner profile as seen in a plan view is quadrangular or generally quadrangular. Namely, the flexible member 52 is shaped like a quadrangular or generally quadrangular frame as seen in a plan view. The flexible member 52 is not limited to having any particular shape as seen in a plan view. When the base member 40 is raised, a top surface of the flexible member 52 and the bottom surface 30*aa* of the ink head unit 30*a* contact each other, and thus the hermetically closed space is formed inside the flexible member 52.

As shown in FIG. 6*a*, the cap 48 has a plurality of holes 48*aa* and a plurality of grooves 48*ab* formed in a top surface thereof. The plurality of grooves 48*ab* connect the plurality of holes 48*aa*. The holes 48*aa* are in communication with the opening 56*a* (see FIG. 5*a*) of the base support member 54, and therefore is in connection with the suction device described above. When the suction device is driven, air in the hermetically closed space inside the flexible member 52 is sucked from the holes 48*aa*, and thus the pressure in the hermetically closed space becomes a negative pressure. Namely, the pressure around the inkjet nozzles 90*a* in the ink head unit 30*a* becomes a negative pressure.

Now, the distance from the center of the cap 48 to a left surface 50*a* of the guide member 50 is defined as L1. As shown in FIG. 2*b*, the distance from the center of an area of the bottom surface 30*aa* of the ink head unit 30*a* that is to define the hermetically closed space (this area of the bottom surface 30*aa* is to be covered with the cap 48) to the guide surface 34*ab* is defined as L2. The guide member 50 is positioned such that length L1 and length L2 are equal to each other. The guide member 50 is positioned such that when the carriage 26 moves from left to right toward the wait position P, the guide member 50 contacts the guide member 34*a* provided on the ink head unit 30*a*. As shown in FIG. 5*a*, the guide member 50 has height h1 with which the guide member 50 can contact the guide member 34*a* provided on the ink head unit 30*a*. In the state where the carriage 26 has moved to the wait position P, the left surface 50*a* of the guide member 50 contacts the guide surface 34*ab* of the guide member 34*a* provided on the ink head unit 30*a*.

Figure 3B:
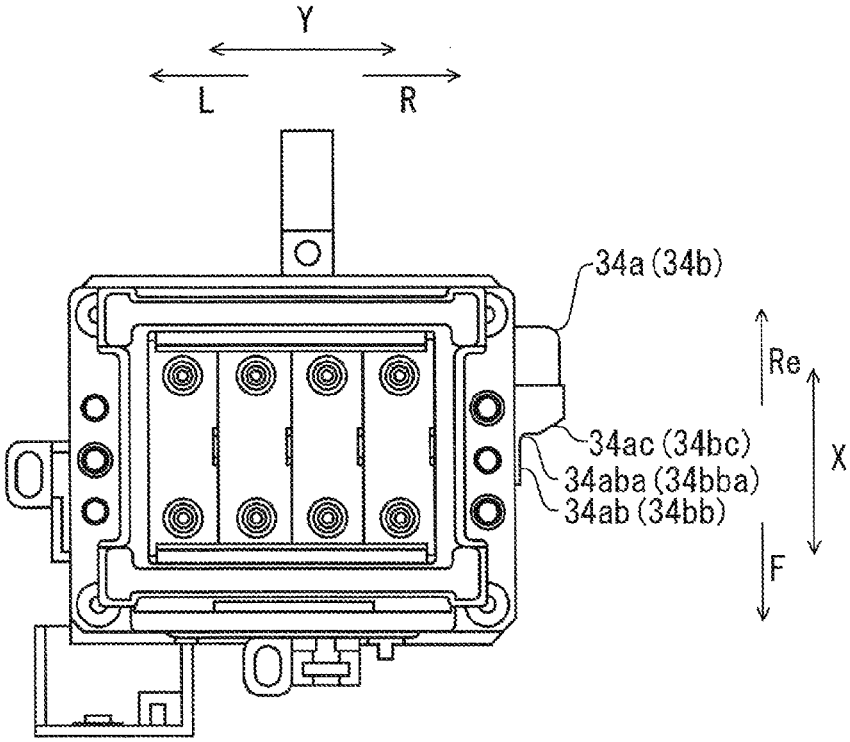
FIG. 3*b* is a plan view thereof.
Figure 7A:
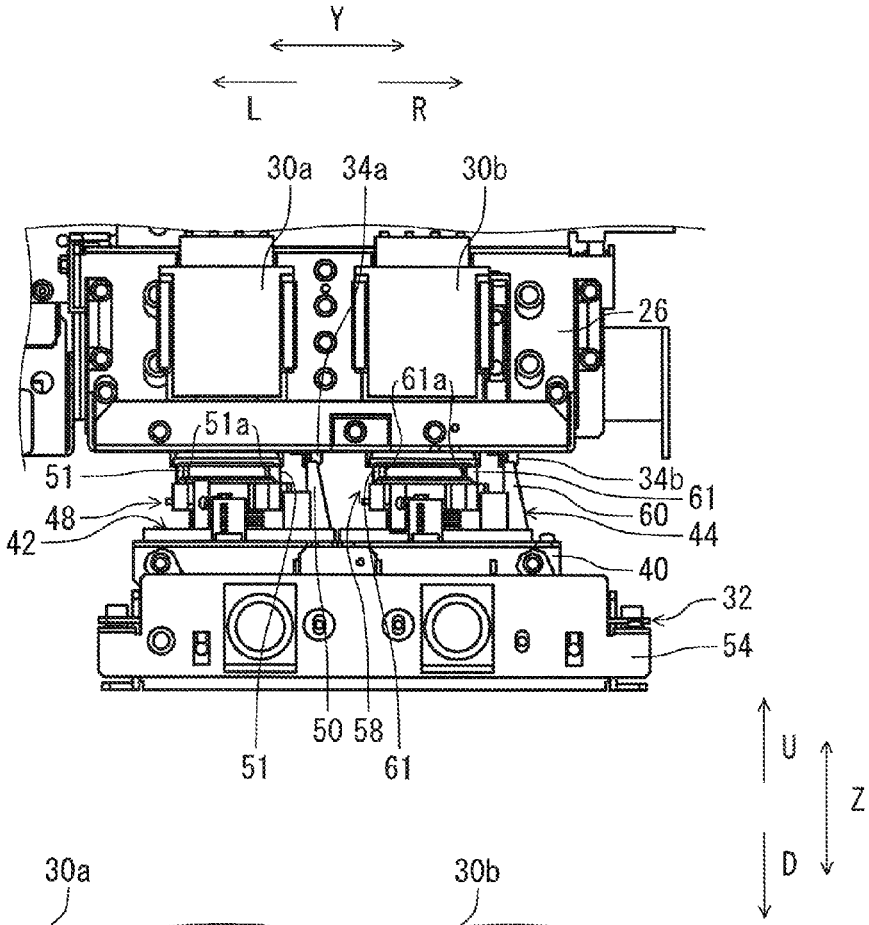
FIG. 7*a* shows a state where one of guide members of the cap device is in contact with the guide member of one of the ink head units.

As shown in FIG. 6*a*, a pair of, namely, left and right, guide members 51 are provided to the rear of the cap 48. The distance in the sub scanning direction X from the center of the cap 48 to a front surface 51*a* (see FIG. 7*a*) of each guide member 51 is defined as L10. As shown in FIG. 2*b*, the distance from the center of the area of the bottom surface 30*aa* of the ink head unit 30*a* that is to define the hermetically closed space to a rear surface of the ink head unit 30*a* is defined as L11. The pair of guide members 51 are positioned such that length L10 and length L11 are equal to each other. The guide members 51 are positioned such that when the carriage 26 moves toward the wait position P, the guide members 51 contact a rear surface 30*ad* (see FIG. 3*b*) of a portion of the ink head unit 30*a* that protrudes downward from the bottom surface 26*a* of the carriage 26. The guide members 51 have a height with which the guide members 51 can contact the rear surface 30*ad* of the portion of the ink head unit 30*a* that protrudes downward from the bottom surface 26*a* of the carriage 26. In the state where the carriage 26 has moved to the wait position P, the front surface 51*a* of each guide member 51 contacts the rear surface 30*ad* of the portion of the ink head unit 30*a* that protrudes downward.

The cap section 44 includes a plate-like member 56, a cap 58 fixed to the plate-like member 56, and the guide member 60 standing on the plate-like member 56. The guide member 60 is located to the right of the cap 58. The plate-like member 66 is located on a right front portion of the top surface 40*a* of the base member 40. The plate-like member 56 is structured so as to be movable in the sub scanning direction X but so as not to be movable in the main scanning direction Y.

As shown in FIG. 6*a*, the distance in the sub scanning direction X from the center of the cap 48 to the center of the cap 58 is defined as L6. As shown in FIG. 2*a*, the distance in the sub scanning direction X from the center of the area of the bottom surface 30*aa* of the ink head unit 30*a* that is to define the hermetically closed space to the center of an area of the bottom surface 30*ba* of the ink head unit 30*b* that is to define a hermetically closed space (this area of the bottom surface 30*ba* is to be covered with the cap 58) is defined as L8. The plate-like member 56 is positioned such that length L6 and length L8 are equal to each other.

As shown in FIG. 6*a*, the distance in the main scanning direction Y from the center of the cap 48 to the center of the cap 58 is defined as L5. Hereinafter, length L5 will be referred to also as "inter-cap center distance L5". As shown in FIG. 2*a*, the distance in the main scanning direction Y from the center of the area of the bottom surface 30*aa* of the ink head unit 30*a* that is to define the hermetically closed space to the center of the area of the bottom surface 30*ba* of the ink head unit 30*b* that is to define the hermetically closed space is defined as L7. Hereinafter, length L7 will be referred to also as "inter-ink head unit distance L7". The plate-like member 56 is positioned such that length L5 is shorter than length L7. A prescribed position for the plate-like member 56 that causes length L5 to be shorter than length L7 is defined as a reference position of the plate-like member 56. The plate-like member 56 is movable between the reference position and a position to the right of the reference position. The distance in which the plate-like member 56 is movable rightward from the reference position is equal, to or longer than, the difference between length L7 and length L5. When, for example, length L5 is 76.5 mm and length L7 is 77.0 mm, the distance in which the plate-like member 56 is movable rightward from the reference position is 0.5 mm or longer. There is no limitation on the numerical value of length L5 or length L7.

As shown in FIG. 6*a*, a spring 68 is connected to the plate-like member 56. One end of the spring 68 is connected to the plate-like member 56, and the other end of the spring 68 is connected to the base member 40. The plate-like member 56 is pulled obliquely leftward and rearward by the spring 68. When the plate-like member 56 is located to the right of the reference position, the spring 68 generates a leftward urging force. Namely, when the plate-like member 56 is located to the right of the reference position, a leftward force is generated in the plate-like member 56. The cap section 44 is located on the right front portion of the top surface 40*a* of the base member 40, and is movable in the main scanning direction in a prescribed range. The cap section 44 is structured to be supplied with a leftward urging force by the spring 68 when the plate-like member 56 moves rightward from the reference position.

The cap 58 includes a flexible member 62 provided in a top portion thereof. The flexible member 62 is formed of a flexible material such as rubber or the like. The flexible member 62 is located such that an outer profile and an inner profile as seen in a plan view is quadrangular or generally quadrangular. Namely, the flexible member 62 is shaped like a quadrangular or generally quadrangular frame as seen in a plan view. The flexible member 62 is not limited to having any particular shape as seen in a plan view. When the base member 40 is raised, a top surface of the flexible member 62 and the bottom surface 30*ba* of the ink head unit 30*b* contact each other, and thus the hermetically closed space is formed inside the flexible member 62. Namely, the hermetically closed space is formed around the ink head nozzles 90*b* in the ink head unit 30*b*.

As shown in FIG. 6*a*, the cap 58 has a plurality of holes 58*aa* and a plurality of grooves 58*ab* formed in a top surface thereof. The plurality of grooves 58*ab* connect the plurality of holes 58*aa*. The holes 58*aa* are in communication with the opening 56*b* (see FIG. 5*a*) of the base support member 54, and therefore is in connection with the another suction device described above. When the another suction device is driven, air in the hermetically closed space inside the flexible member 62 is sucked from the holes 58*aa*, and thus the pressure in the hermetically closed space becomes a negative pressure. Namely, the pressure around the inkjet nozzles 90*b* in the ink head unit 30*b* becomes a negative pressure.

As shown in FIG. 6*a*, the distance from the center of the cap 58 to a left surface 60*a* of the guide member 60 is defined as L3. As shown in FIG. 2*b*, the distance from the center of the area of the bottom surface 30*ba* of the ink head unit 30*b* that is to define the hermetically closed space to the guide surface 34*bb* is defined as L4. The guide member 60 is positioned such that length L3 and length L4 are equal to each other. The guide member 60 is positioned such that when the carriage 26 moves from left to right toward the wait position P, the guide member 60 contacts the guide member 34*b* provided on the ink head unit 30*b*. As shown in FIG. 5*a*, the guide member 60 has height h2 with which the guide member 60 can contact the guide member 34*b* provided on the ink head unit 30*b*. In the state where the carriage 26 has moved to the wait position P, the left surface 60*a* of the guide member 60 contacts the guide surface 34*bb* of the guide member 34*b* provided on the ink head unit 30*b*.

As described above, inter-cap center distance L5 is shorter than inter-ink head unit distance L7. Therefore, when the carriage 26 moves from left to right toward the wait position P, the guide surface 34*bb* of the guide member 34*b* contacts the left surface 60*a* of the guide member 60, and after this, the guide surface 34*ab* of the guide member 34*a* contacts the left surface 50*a* of the guide member 50.

A pair of, namely, left and right, guide members 61 are provided to the rear of the cap 58. The distance in the sub scanning direction X from the center of the cap 58 to a front surface 61*a* (see FIG. 7*a*) of each guide member 61 is defined as L12. As shown in FIG. 2*b*, the distance from the center of the area of the bottom surface 30*ba* of the ink head unit 30*b* that is to define the hermetically closed space to a rear surface of the ink head unit 30*b* is defined as L13. The pair of guide members 61 are positioned such that length L12 and length L13 are equal to each other. The guide members 61 are positioned such that when the carriage 26 moves toward the wait position P, the guide members 61 contact a rear surface 30*bd* (see FIG. 3*a*) of a portion of the ink head unit 30*b* that protrudes downward from the bottom surface 26*a* of the carriage 26. The guide members 61 have a height with which the guide members 61 can contact the rear surface 30*bd* of the portion of the ink head unit 30*b* that protrudes downward from the bottom surface 26*a* of the carriage 26. In the state where the carriage 26 has moved to the wait position P, the front surface 61*a* of each guide member 61 contacts the rear surface 30*bd* of the portion of the ink head unit 30*b* that protrudes downward.

The base member 40 is supported by four support members 58*a*, 58*b*, 58*c* and 58*d* (see FIG. 6*b*) so as to be movable upward and downward with respect to the base support member 54. As shown in FIG. 5*a*, a top end portion of the support member 58*a* is pivotably supported in the vicinity of a left end portion of a front wall 40*b* of the base member 40. A bottom end portion of the support member 58*a* is pivotably supported by a support shaft 64*a*. As shown in FIG. 6*b*, the support shaft 64*a* is suspended between the front wall 54*a* and a rear wall 54*b* of the base support member 54. The support shaft 64*a* is located in a left portion of the base support member 54. A top end portion of the support member 58*c* is pivotably supported in the vicinity of a left end portion of a rear wall 40*c* of the base member 40. A bottom end portion of the support member 58*c* is pivotably supported by the support shaft 64*a*. The support members 58*a* and 58*c* are slidably supported by the support shaft 64*a*.

As shown in FIG. 5*a*, a top end portion of the support member 58*b* is pivotably supported in the vicinity of a right end portion of the front wall 40*b* of the base member 40. A bottom end portion of the support member 58*b* is pivotably supported by a support shaft 64*b*. As shown in FIG. 6*b*, the support shaft 64*b* is suspended between the front wall 54*a* and the rear wall 54*b* of the base support member 54. The support shaft 64*b* is located in a right portion of the base support member 54. A top end portion of the support member 58*d* is pivotably supported in the vicinity of a right end portion of the rear wall 40*c* of the base member 40. A bottom end portion of the support member 58*d* is pivotably supported by the support shaft 64*b*. The support members 58*b* and 58*d* are slidably supported by the support shaft 64*b*.

When the base member 40 is at a lowermost position, the support members 58*a*, 58*b*, 58*c* and 58*d* extend with the top end portions thereof being on the left and the bottom end portions thereof being on the right. The support members 58*a*, 58*b*, 58*c* and 58*d* are each pivotable until the top end portion thereof is vertically above the bottom end portion. The support members 58*a*, 58*b*, 58*c* and 58*d* are each pivotable in a limited range of angles such that the pivoting angle thereof is maximum when the top end portion thereof is vertically above the bottom end portion thereof.

As shown in FIG. 6*b*, springs 66 are connected to a bottom wall 40*b* of the base member 40. One end of each spring 66 is connected to the base member 40, and the other end of each spring 66 is connected to the base support member 54. The base member 40 is urged obliquely leftward and rearward by the springs 66. Namely, the base member 40 is supplied with a leftward force by the springs 66. The base member 40 is also supplied with a rearward force by the springs 66.

Referring to FIG. 5*a*, when a rightward force is applied to the base member 40, the support members 58*a* and 58*c* are pivoted in a direction of arrow A about the support shaft 64*a*, and the support members 58*b* and 58*d* are pivoted in a direction of arrow B about the support shaft 64*b*. As a result, the base member 40 is moved upward. Namely, the base member 40 is raised. As described above, the range of angles in which each of the support members 58*a*, 58*b*, 58*c* and 58*d* is pivotable is limited, and the support members 58*a*, 58*b*, 58*c* and 58*d* are each pivoted only until the top end portion thereof connected to the base member 40 reaches an uppermost position. Therefore, while the rightward force is applied to the base member 40, the base member 40 is not lowered.

The base member 40 is acted on by a leftward urging force by the springs 66. Referring to FIG. 5*b*, when, in the state where the base member 40 is raised, the base member 40 is released from the rightward force, the support members 58*a* and 58*c* are pivoted in a direction of arrow C about the support shaft 64*a*, and the support members 58*b* and 58*d* are pivoted in a direction of arrow D about the support shaft 64*b*. As a result, the base member 40 is moved downward. Namely, the base member 40 is lowered.

In this manner, the base member 40 can be lowered to the lowermost position by an urging force of the springs 66. When being supplied with a rightward force equal to, or larger than, the urging force of the springs 66, the base member 40 can be raised to the uppermost position.

When a forward force is applied to the base member 40, the base member 40 moves from rear to front on the support shafts 64*a* and 64*b* via the support members 58*a*, 58*b*, 58*c* and 58*d*. The base member 40 is acted on by a rearward urging force by the springs 66. When, in the state where the base member 40 has been moved forward, the base member 40 is released from the forward force, the base member 40 moves from front to rear on the support shafts 64*a* and 64*b*.

In this manner, the base member 40 can be moved from rear to front on the base support member 54. In the state of having been moved forward, the base member 40 can be moved from front to rear by an urging force of the springs 66.

Now, an operation for causing the cap device 32 to perform capping for the ink head section 30 will be described.

Figure 7B:
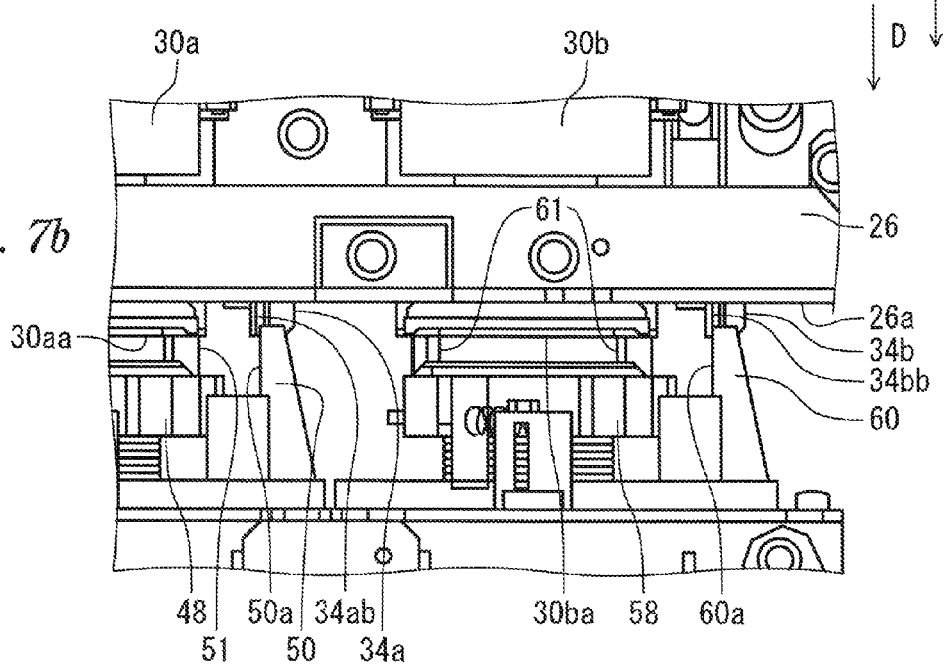
FIG. 7*b* is a partial enlarged view of FIG. 7*a*.

Capping for the ink head section 30 is performed at the wait position P. At a prescribed timing, for example, when the printing is finished, the carriage 26 moves from left to right toward the wait position P (see FIG. 7*a*). As shown in FIG. 7*b*, before the carriage 26 reaches the wait position P, the guide surface 34*bb* of the guide member 34*b* contacts the left surface 60*a* of the guide member 60. As a result, the position of the cap 58 in the main scanning direction Y with respect to the ink head unit 30*b* is fixed. At this point, the guide surface 34*ab* of the guide member 34*a* has not contacted yet the left surface 50*b* of the guide member 50.

When the carriage 26 further moves rightward toward the wait position P, the guide surface 34*bb* of the guide member 34*b* presses rightward the left surface 60*a* of the guide member 60. As a result, the cap section 44 moves rightward against the urging force of the spring 68. In this state, the position of the cap 58 in the main scanning direction Y with respect to the ink head unit 30*b* is kept fixed. While the cap section 44 moves rightward, the position of the cap 58 in the main scanning direction Y with respect to the ink head unit 30*b* does not change.

Figure 8A:
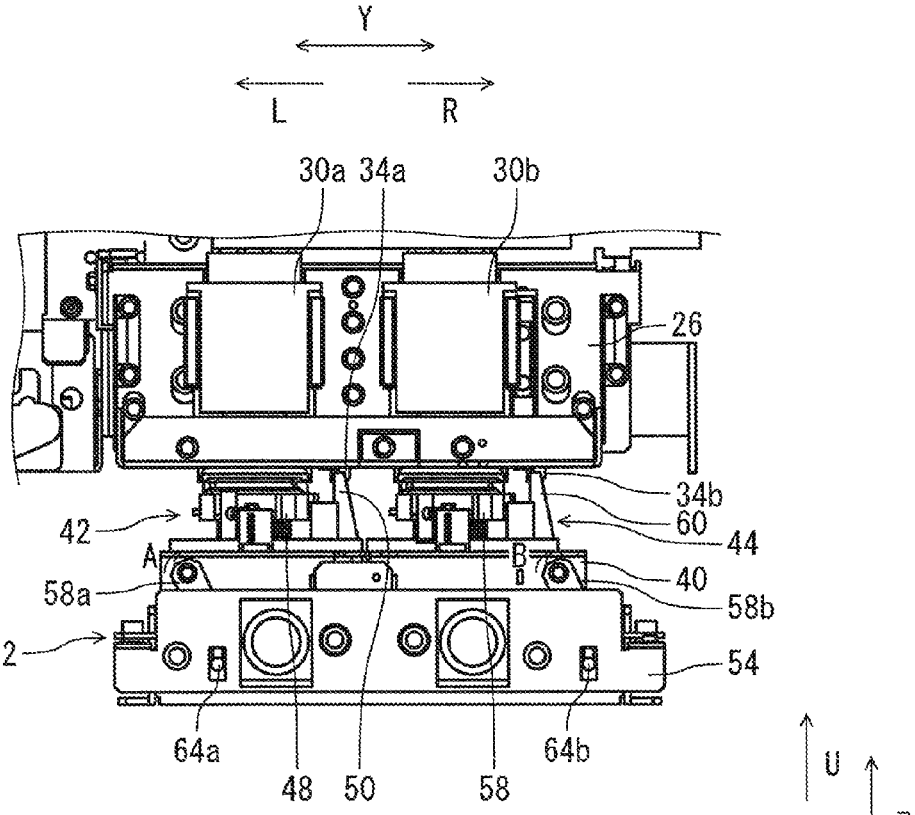
FIG. 8*a* shows a state where one of the guide members of the cap device is in contact with the guide member of one of the ink head units and also the other guide member of the cap device is in contact with the guide member of the other ink head unit.
Figure 8B:
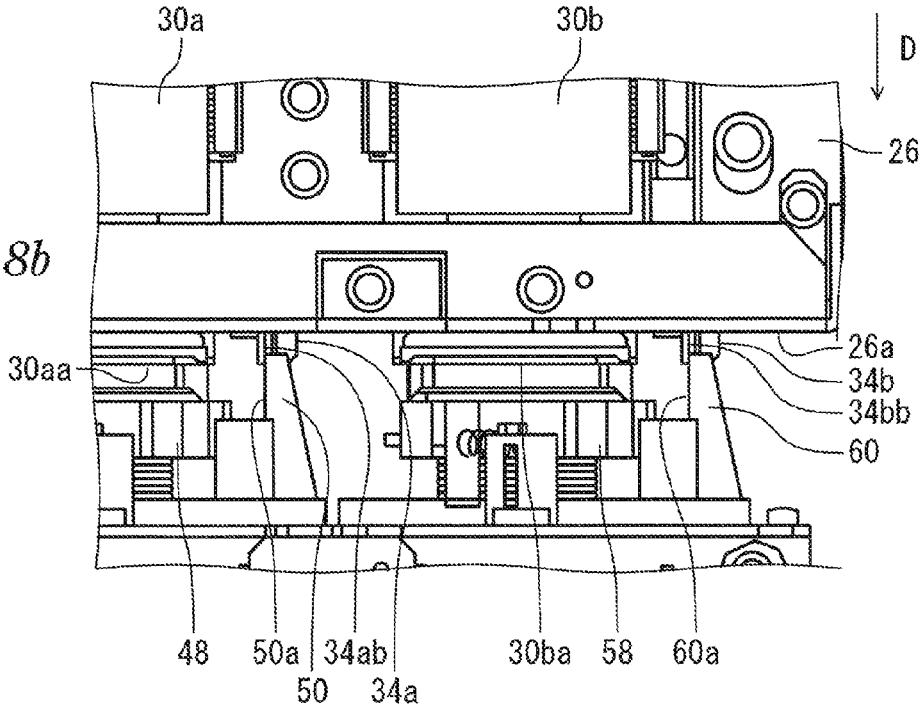
FIG. 8*b* is a partial enlarged view of FIG. 8*a*.

As shown in FIG. 8*b*, when the carriage 26 further moves rightward toward the wait position P, the guide surface 34*ab* of the guide member 34*a* contacts the left surface 50*a* of the guide member 50. At this point, the position of the cap 48 in the main scanning direction Y with respect to the ink head unit 30*a* is fixed.

When the carriage 26 further moves rightward toward the wait position P, the guide surface 34*ab* of the guide member 34*a* presses rightward the left surface 50*a* of the guide member 50. The guide member 50 stands on the plate-like member 46, and the plate-like member 46 is fixed to the base member 40. Therefore, when the guide member 50 is pressed rightward, a rightward force is generated in the base member 40. Namely, a force directed from left to right is generated in the base member 40 against the urging force of the springs 66. Referring to FIG. 8*a*, by the force generated in the base member 40, the support members 58*a* and 58*c* are pivoted in the direction of arrow A about the support shaft 64*a*, and the support members 58*b* and 58*d* are pivoted in the direction of arrow B about the support shaft 64*b*. As a result, the base member 40 is raised.

Figure 9:
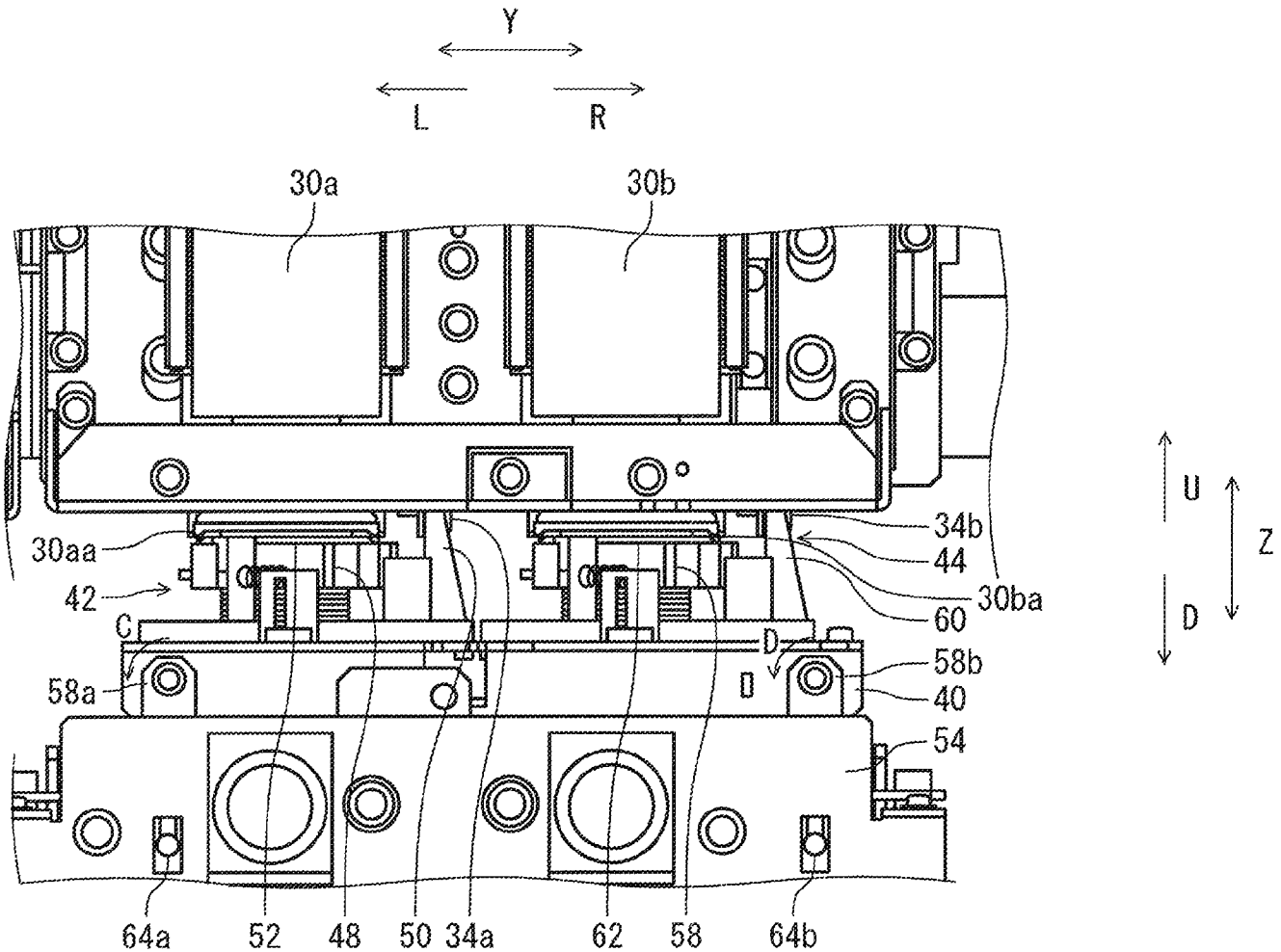
FIG. 9 shows a state where caps and the ink head units are in contact with each other.

When the carriage 26 further moves rightward and reaches the wait position P, the base member 40 reaches the uppermost position. As shown in FIG. 9, the flexible member 52 of the cap 48 closely contact the bottom surface 30*aa* of the ink head unit 30*a*, and thus the hermetically closed space is formed around the ink jet nozzles 90*a* (see FIG. 3*a*) provided on the bottom surface 30*aa*. In addition, the flexible member 62 of the cap 58 closely contact the bottom surface 30*ba* of the ink head unit 30*b*, and thus the hermetically closed space is formed around the ink jet nozzles 90*b* (see FIG. 3*a*) provided on the bottom surface 30*ba*.

As described below, the position of the cap 58 in the sub scanning direction X with respect to the ink head unit 30*b* is fixed at the same time when the position of the cap 58 in the main scanning direction Y with respect to the ink head unit 30*b* is fixed. The position of the cap 48 in the sub scanning direction X with respect to the ink head unit 30*a* is fixed at the same time when the position of the cap 48 in the main scanning direction Y with respect to the ink head unit 30*a* is fixed.

This will be described more specifically. Before the guide surface 34*bb* of the guide member 34*b* contacts the left surface 60*a* of the guide member 60, the guide surface 34*bc* of the guide member 34*b* contacts the guide member 60. When the carriage 26 moves toward the wait position P while the guide surface 34*bc* is in contact with the guide member 60, the guide member 60 is guided by the guide surface 34*bc*, and a force directed from rear to front is generated in the guide member 60. The guide member 60 is provided on the plate-like member 56, and the plate-like member 56 is provided on the base member 40. Since the force directed from rear to front is generated in the guide member 60, a force directed from rear to front is generated in the base member 40.

Before the guide surface 34*ab* of the guide member 34*a* contacts the left surface 50*a* of the guide member 50, the guide surface 34*ac* of the guide member 34*a* contacts the guide member 50. When the carriage 26 moves toward the wait position P while the guide surface 34*ac* is in contact with the guide member 50, the guide member 50 is guided by the guide surface 34*ac*, and a force directed from rear to front is generated in the guide member 50. The guide member 50 is provided on the plate-like member 46, and the plate-like member 46 is provided on the base member 40. Since the force directed from rear to front is generated in the guide member 50, a force directed from rear to front is generated in the base member 40.

The base member 40 is moved from rear to front by the forward force generated in the guide member 60 and the forward force generated in the guide member 50.

When the carriage 26 further moves rightward toward the wait position P, the guide surface 34*bb* of the guide member 34*b* contacts the left surface 60*a* of the guide member 60, and the position of the cap 58 in the main scanning direction Y with respect to the ink head unit 30*b* is fixed. At this point, the front surfaces 61*a* of the pair of guide members 61 contact the rear surface 30*bd* of the portion of the ink head unit 30*b* that protrudes downward from the bottom surface 26*a* of the carriage 26. As a result, the position of the cap 58 in the sub scanning direction X with respect to the ink head unit 30*b* is fixed.

In addition, the guide surface 34*ab* of the guide member 34*a* contacts the left surface 50*a* of the guide member 50, and the position of the cap 48 in the main scanning direction Y with respect to the ink head unit 30*a* is fixed. At this point, the front surfaces 51*a* of the pair of guide members 51 contact the rear surface 30*ad* of the portion of the ink head unit 30*a* that protrudes downward from the bottom surface 26*a* of the carriage 26. As a result, the position of the cap 48 in the sub scanning direction X with respect to the ink head unit 30*a* is fixed.

Now, an operation for releasing the cap device 32 from the state of performing capping for the ink head section 30 will be described.

The carriage 26 starts moving leftward from the wait position P at a prescribed timing, for example, at the start of the printing. When this occurs, a force directed from right to left is generated in the base member 40 by an urging force of the springs 66. Then, as shown in FIG. 9, the support members 58*a* and 58*c* are pivoted in the direction of arrow C about the support shaft 64*a*, and the support members 58*b* and 58*d* are pivoted in the direction of arrow D about the support shaft 64*b*. As a result, the base member 40 is lowered.

When the base member 40 starts lowering, the flexible member 52 of the cap section 42 is separated from the bottom surface 30*aa* of the ink head unit 30*a*, and the inkjet nozzles 90*a* are released from the capped state. In addition, the flexible member 62 of the cap section 44 is separated from the bottom surface 30*ba* of the ink head unit 30*b*, and the inkjet nozzles 90*b* is released from the capped state.

When the carriage 26 further moves leftward, the guide surface 34*ab* of the guide member 34*a* is separated from the left surface 50*a* of the guide member 50 (see FIG. 7*b*). At this point, the cap section 44 starts moving leftward by an urging force of the spring 68. When the carriage 26 further moves leftward, the guide surface 34*bb* of the guide member 34*b* is separated from the left surface 60*a* of the guide member 60. At this point, the cap section 44 is moved leftward by an urging force of the spring 68. As a result, the plate-like member 56 is located at the reference position. Then, the base member 40 is lowered to the lowermost position by an urging force of the springs 66.

When the guide surface 34*ab* of the guide member 34*a* is separated from the guide member 50 as a result of the leftward movement of the carriage 26, the guide member 50 is guided by the guide surface 34*ac*. When the guide surface 34*bb* of the guide member 34*b* is separated from the left surface 60*a* of the guide member 60 as a result of the further leftward movement of the carriage 26, the guide member 60 is guided by the guide surface 34*bc*. When the carriage 26 further moves leftward, the guide surface 34*ac* of the guide member 34*a* is separated from the guide member 50, and the guide surface 34*bc* of the guide member 34*b* is separated from the guide member 60. The base member 40 is supplied with an urging force directed from front to rear by the springs 66 and thus is moved from front to rear.

As described above, the inkjet printer 10 in this embodiment includes the carriage 26 movable in the main scanning direction Y between the printing position and the wait position P, the ink head unit 30*a* which has the bottom surface 30*aa* having the inkjet nozzles 90*a* formed thereon and is mounted on the carriage 26, and the ink head unit 30*b* which has the bottom surface 30*ba* having the inkjet nozzles 90*b* formed thereon and is mounted on the carriage 26. The ink head unit 30*a* is an example of a "first ink head unit", and the ink head unit 30*b* is an example of a "second ink head unit".

The cap device 32 includes the base member 40, the plate-like member 46 as an example of a "first table", a cap 48 as an example of a "first cap", a guide member 50 as an example of a "first guide member", the plate-like member 56 as an example of a "second table", a cap 58 as an example of a "second cap", a guide member 60 as an example of a "second guide member", a guide member 34*a* as an example of a "third guide member", and a guide member 34*b* as an example of a "fourth guide member". The plate-like member 46 is provided so as not to be movable in the main scanning direction with respect to the base member 40. The cap 48 is provided on the plate-like member 46 and is contactable with the bottom surface 30*aa* of the ink head unit 30*a* by being raised. The guide member 50 has the left surface 50*a* directed in a leftward direction as an example of a "second direction", and is provided on the plate-like member 46. The left surface 50*a* is an example of a "first contact surface". The plate-like member 56 is provided so as to be movable in the main scanning direction with respect to the base member 40. The cap 58 is provided on the plate-like member 56 and is contactable with the bottom surface 30*ba* of the ink head unit 30*b* by being raised. The guide member 60 has the left surface 60*a* located to the right of, or in a rightward direction with respect to, the left surface 50*a* and directed in the leftward direction. The guide member 60 is provided on the plate-like member 56. The rightward direction is an example of a "first direction". The left surface 60*a* is an example of a "second contact surface". The guide member 34*a* has the guide surface 34*ab* facing the left surface 50*a*, is provided on the ink head unit 30*a*, and protrudes downward from the carriage 26. The guide surface 34*ab* is an example of a "third contact surface". The guide member 34*b* has the guide surface 34*bb* located to the right of the guide surface 34*ab* and facing the left surface 60*a*. The guide member 34*b* is provided on the ink head unit 30*b*, and protrudes downward from the carriage 26. The guide surface 34*bb* is an example of a "fourth contact surface". The guide member 50, the guide member 60, the guide member 34*a* and the guide member 34*b* are located such that when the carriage 26 moves rightward, the left surface 60*a* and the guide surface 34*bb* contact each other and after this, the left surface 50*a* and the guide surface 34*ab* contact each other.

Owing to the cap device 32 having the above-described structure, the position of the cap 58 in the main scanning direction Y, even if being deviated from a prescribed position during the production of the inkjet printer 10 due to variation of the size of components or the like, is corrected when the carriage 26 moves to the wait position P. This allows the cap 58 to closely contact an appropriate position in the bottom surface 30*ba* of the ink head unit 30*b*. Thus, the hermetically closed space can be formed around the inkjet nozzles 90*b* provided on the bottom surface 30*ba*.

In the cap device 32, the plate-like member 56 is located at the reference position at which, when the left surface 60*a* and the guide surface 34*bb* are not in contact with each other and the left surface 50*a* and the guide surface 34*ab* are not in contact with each other, length L5 (see FIG. 6*a*) in the main scanning direction Y from the center of the cap 48 to the center of the cap 58 is shorter than length L7 (see FIG. 2*a*) in the main scanning direction Y from the center of the area of the ink head unit 30*a* that is to be covered with the cap 48 to the center of the area of the ink head unit 30*b* that is to be covered with the cap 58.

Owing to this, when the carriage 26 moves rightward toward the wait position P, the left surface 60*a* and the guide surface 34*bb* first contact each other and after this, the left surface 50*a* and the guide surface 34*ab* contact each other.

As shown in FIG. 6*a*, the cap device 32 includes the spring 68, which is connected to the base member 40 and the plate-like member 56 and supplies the plate-like member 56 with a force for urging the plate-like member 56 toward the reference position.

Owing to this, when the left surface 60*a* and the guide surface 34*bb* are not in contact with each other and the left surface 50*a* and the guide surface 34*ab* are not in contact with each other, the plate-like member 56 is automatically located at the reference position by the force of the spring 68.

The plate-like member 56 is structured so as to be movable in the sub scanning direction X. In this embodiment, the plate-like member 56 is provided on the base member 40, and the base member 40 is provided so as to be movable in the sub scanning direction X with respect to the base support member 54. The plate-like member 56 is structured so as to be movable in the sub scanning direction X via the base member 40.

Since the plate-like member 56 is movable in the sub scanning direction X, the position of the cap 58 in the sub scanning direction X can be corrected. In this embodiment, the position of the cap 58 both in the main scanning direction Y and the sub scanning direction X can be corrected.

As shown in FIG. 2*b*, the guide member 34*b* has the guide surface 34*bc* inclining rightward and rearward from the rear end 34*bba* of the guide surface 34*bb*.

Owing to this, when the carriage 26 moves rightward toward the wait position P, before the guide surface 34*bb* of the guide member 34*b* contacts the left surface 60*a* of the guide member 60, the guide surface 34*bc* of the guide member 34*b* contacts the guide member 60. The guide member 60 is guided forward by the guide surface 34*bc*. Therefore, the cap 58 is moved forward, and thus the position of the cap 58 in the sub scanning direction X is determined. In the case where it is intended to move the cap 58 rearward while the carriage 26 moves rightward toward the wait position P, the guide surface 34*bc* is structured to be inclined rightward and forward from a front end of the guide surface 34*bb*.

As shown in FIG. 6*a* and FIG. 6*b*, the cap device 32 includes the base support member 54 located below the base member 40, the support members 58*a*, 58*b*, 58*c* and 58*d*, and the springs 66, connected between the base support member 54 and the base member 40, for supplying the base member 40 with a leftward force. As shown in FIG. 5*a* and FIG. 5*b*, the support members 58*a*, 58*b*, 58*c* and 58*d* each have the top end portion pivotably supported by the base member 40 and the bottom end portion pivotably supported by the base support member 54 (in this embodiment, the support shafts 64*a* and 64*b* of the base support member 54). The top end portion is located vertically above, or to the left of, the bottom end portion.

Owing to this, when a rightward force is applied to the base member 40, the base member 40 is moved rightward while being raised. When being released from the rightward force, the base member 40 is moved leftward while being lowered by an urging force of the springs 66. Owing to such a structure, there is no need to provide a driving force for moving the base member 40 upward and downward, which reduces the cost.

So far, an embodiment of the present invention has been described. The present invention is not limited to the above-described embodiment, but may be carried out in any of various other embodiments. Now, some of such other embodiments will be described.

In the above-described embodiment, the carriage 26 has two ink head units 30*a* and 30*b* mounted thereon, and the cap device 32 includes two cap sections 42 and 44. The number of ink head units mountable on the carriage 26 is not limited to two, and the number of cap sections included in the cap device 32 is not limited to two. Three or more ink head units may be provided, and the same number of cap sections as that of the ink head units may be provided.

Figure 10A:
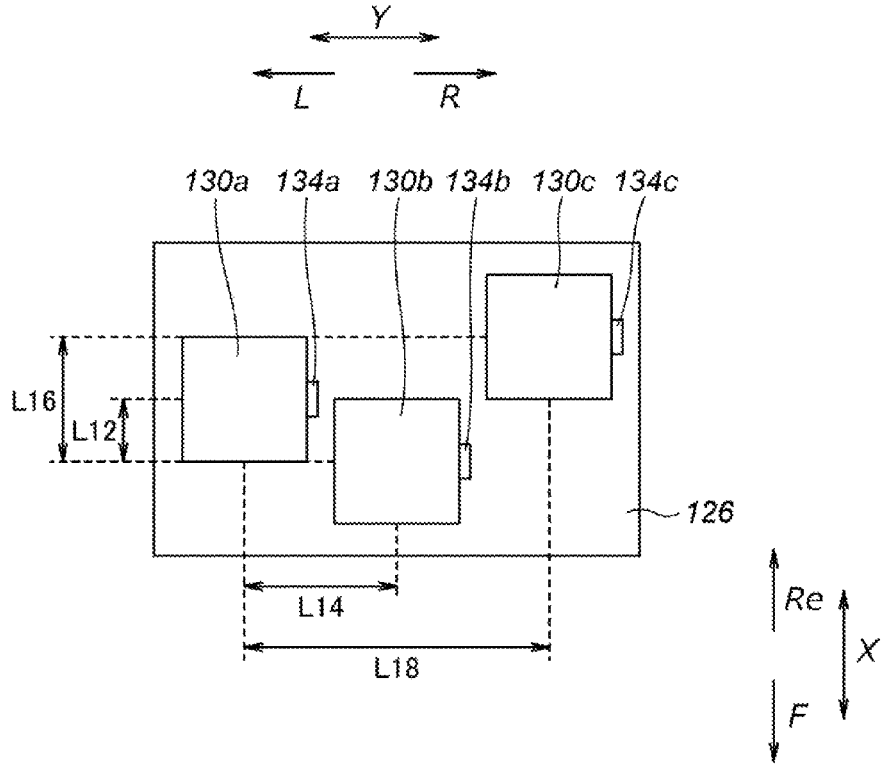
FIG. 10*a* shows a carriage having three ink head units mounted thereon.
Figure 10B:
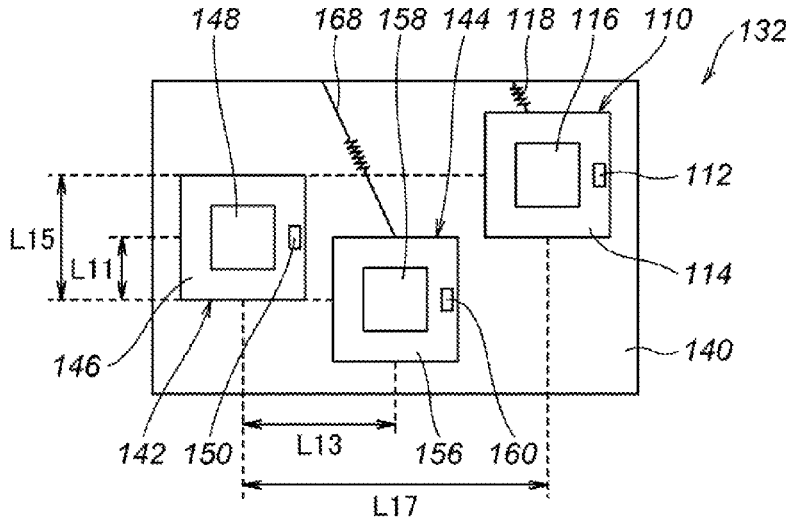
FIG. 10*b* shows a part of a cap device for performing capping for the ink head units shown in FIG. 10*a*.
Figure 11A:
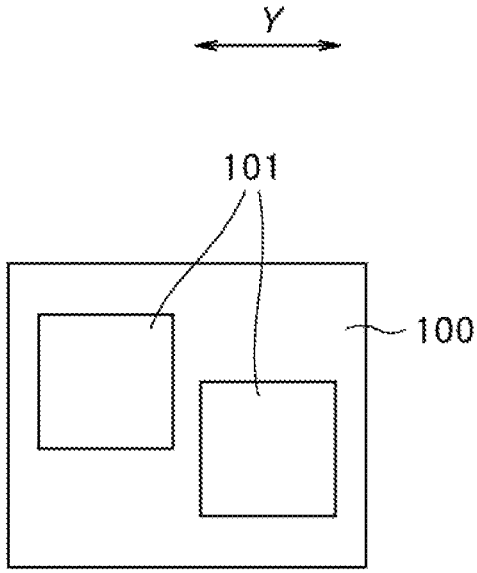
FIG. 11*a* and FIG. 11*b* each show a carriage having a plurality of ink head units mounted thereon.
Figure 11B:
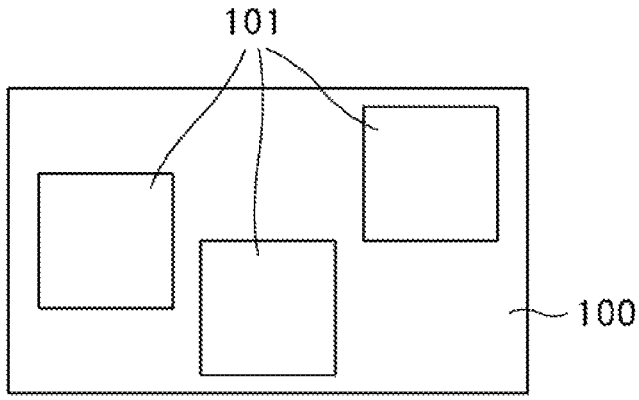

As an example, a structure in which a carriage has three ink head units mounted thereon will be described with reference to FIG. 10 and FIG. 10*b*.

The shapes and positions of the guide members, the structure of the cap sections, the mechanism for moving the base member upward and downward, and the structure and positions of the ink head units (e.g., the structure in which the ink head units and the guide members provided on the ink head units protrude downward from the bottom surface of the carriage), for example, are the same as those described above and will not be described in detail.

A carriage 126 has three ink head units 130*a*, 130*b* and 130*c* mounted thereon. Guide members 134*a*, 134*b* and 134*c* are respectively provided to the right of the ink head units 130*a*, 130*b* and 130*c*. The ink head unit 130*a* is located in a left portion of the carriage 126, at generally the central position in the sub scanning direction X. The ink head unit 130*c* is located in a right rear portion of the carriage 126. The ink head unit 130*b* is located in a front portion of the carriage 126, at an intermediate position between the ink head unit 130*a* and the ink head unit 130*c* in the main scanning direction Y.

A cap device 132 includes a base member 140 located on a base support member so as to be movable upward and downward, and cap sections 142, 144 and 110 located on the base member 140. The base member 140 is connected to a spring provided on the base support member (corresponding to the springs 66 in the above-described embodiment; not shown in FIG. 10*b*), and is always urged from right to left.

The cap section 142 is located on a left portion of a top surface of the base member 140, at generally the central position in the sub scanning direction X. The cap section 110 is located in a right rear portion of the top surface of the base member 140. The cap section 144 is located in a front portion of the top surface of the base member 140, at an intermediate position between the cap section 142 and the cap section 110 in the main scanning direction Y.

The cap section 142 includes a plate-like member 146, a guide member 150 standing on the plate-like member 146, and a cap 148 fixed to the plate-like member 146. The plate-like member 146 is located on a left portion of the top surface of the base member 140, at generally the central position in the sub scanning direction X.

The cap section 110 includes a plate-like member 114, a guide member 112 standing on the plate-like member 114, and a cap 116 fixed to the plate-like member 114. The plate-like member 114 is located on a right rear portion of the top surface of the base member 140. The plate-like member 114 is structured so as to be movable in the main scanning direction Y within a prescribed range. The plate-like member 114 is connected to a spring 118, which is connected to the base member 140, and is urged from right to left by the spring 118.

The cap section 144 includes a plate-like member 156, a guide member 160 standing on the plate-like member 156, and a cap 158 fixed to the plate-like member 156. The plate-like member 156 is located on a front portion of the top surface of the base member 140, at an intermediate position between the plate-like member 146 and the plate-like member 114 in the main scanning direction Y. The plate-like member 156 is structured so as to be movable in the main scanning direction Y within a prescribed range. The plate-like member 156 is connected to a spring 168, which is connected to the base member 140, and is urged from right to left by the spring 168.

Now, the distance in the sub scanning direction X from the center of the cap 158 to the center of the cap 116 is defined as L15. The distance in the sub scanning direction X from the center of an area of a bottom surface of the ink head unit 130*b* that is to define a hermetically closed space to the center of an area of a bottom surface of the ink head unit 130*c* that is to define a hermetically closed space is defined as L16. The plate-like member 114 is positioned such that length L15 and length L16 are equal to each other. The distance in the main scanning direction Y from the center of the cap 148 to the center of the cap 116 is defined as L17. The distance in the main scanning direction Y from the center of an area of a bottom surface of the ink head unit 130*a* that is to define a hermetically closed space to the center of the area of the bottom surface of the ink head unit 130*c* that is to define the hermetically closed space is defined as L18. The plate-like member 114 is positioned such that length L17 is shorter than length L18.

The distance in the sub scanning direction X from the center of the cap 148 to the center of the cap 158 is defined as L11. The distance in the sub scanning direction X from the center of the area of the bottom surface of the ink head unit 130*a* that is to define the hermetically closed space to the center of the area of the bottom surface of the ink head unit 130*b* that is to define the hermetically closed space is defined as L12. The plate-like member 156 is positioned such that length L11 and length L12 are equal to each other. The distance in the main scanning direction Y from the center of the cap 148 to the center of the cap 158 is defined as L13. The distance in the main scanning direction Y from the center of the area of the bottom surface of the ink head unit 130*a* that is to define the hermetically closed space to the center of the area of the bottom surface of the ink head unit 130*b* that is to define the hermetically closed space is defined as L14. The plate-like member 156 is positioned such that length L13 is shorter than length L14.

The difference between length L13 and length L14 is smaller than the difference between length L17 and length L18. Alternatively, the difference between length L13 and length L14 may be equal to the difference between length L17 and length L18. Still alternatively, the difference between length L13 and length L14 may be larger than the difference between length L17 and length L18.

The carriage 126 moves from left to right when moving toward the wait position P. Where the left side is defined as a start side and the right side is defined as an end side, the cap 148 is located closest to the start side among the three caps. The caps 158 and 116 are located closer to the end side than the cap located closest to the start side. In this embodiment, the cap located closest to the start side is not movable in the main scanning direction Y, whereas all the other caps located closer to the end side than the above-mentioned cap are movable in the main scanning direction Y.

The inkjet printer including the cap device 132 is operated as follows. When the carriage 126 moves from left to right toward the wait position at a prescribed timing, for example, after the finish of the printing, first, the guide member 112 contacts the guide member 134*c*, and the position of the cap 116 in the main scanning direction Y with respect to the ink head unit 130*c* is fixed. Next, the guide member 160 contacts the guide member 134*b*, and the position of the cap 158 in the main scanning direction Y with respect to the ink head unit 130*b* is fixed.

When the carriage 126 further moves toward the wait position, the cap section 110 moves rightward against an urging force of the spring 118, and the cap section 144 moves rightward against an urging force of the spring 168. At this point, the guide member 150 has not contacted yet the guide member 134*a*.

When the carriage 126 further moves toward the wait position, the guide member 134*a* contacts the guide member 150, and presses rightward the guide member 150. As a result, a rightward force is applied to the guide member 150. The guide member 150 stands on the plate-like member 146, and the plate-like member 146 is fixed to the base member 140. When the rightward force is applied to the guide member 150, a force directed from left to right is generated in the base member 140. As a result, the base member 140 is raised.

When the carriage 126 reaches the wait position, the base member 140 is raised to an uppermost position. The cap 110 and the bottom surface of the ink head unit 130*c* closely contact each other, the cap 144 and the bottom surface of the ink head unit 130*b* closely contact each other, and the cap 142 and the bottom surface of the ink head unit 130*a* closely contact each other.

When the carriage 126 starts moving leftward from the wait position at a prescribed timing, for example, at the start of the printing, a force directed from right to left is generated in the base member 140 by an urging force of the spring (corresponding to the springs 66 in the above-described embodiment). As a result, the base member 140 is lowered.

When the base member 140 start lowering, the cap section 110 is released from the state of closely contacting the bottom surface of the ink head unit 130*c*, the cap section 144 is released from the state of closely contacting the bottom surface of the ink head unit 130*b*, and the cap section 142 is released from the state of closely contacting the bottom surface of the ink head unit 130*a*.

When the carriage 126 further moves leftward, the guide member 134*a* is separated from the guide member 150, and the guide member 134*b* is separated from the guide member 160. When the carriage 126 further moves leftward, the guide member 134*c* is separated from the guide member 112. At this point, the cap section 110 is moved leftward by an urging force of the spring 118, and the plate-like member 114 is located at the reference position. In addition, the cap section 144 is moved leftward by an urging force of the spring 168, and the plate-like member 156 is located at the reference position.

Then, the base member 140 is lowered to a lowermost position by an urging force of the spring (corresponding to the springs 66 in the above-described embodiment).

In the above-described embodiments, the carriage 26 reaches the wait position P by moving from left to right. The carriage 26 is not limited to having such a structure. The side unit 18 may be provided on the side member 16L side, and the wait position P may be set in the side unit 18. In this case, the cap section 42 of the cap device 32 is provided so as to be movable in the main scanning direction Y with respect to the base member 40, whereas the cap section 44 is fixed to the base member 40. The guide members 50 and 60 provided on the plate-like members 46 and 56 are located to the left of the caps 48 and 58 respectively, and the guide members 34*a* and 34*b* are provided to the left of the ink head units 30*a* and 30*b* respectively.

This will be described more specifically. Regarding the main scanning direction Y, the side approaching the wait position P is defined as an end side, and the side distanced from the wait position P is defined as a start side. The cap section on the end side is structured so as to be movable in the main scanning direction Y, whereas the cap section on the start side is structured so as not to be movable in the main scanning direction Y. The guide members 34*a* and 34*b* are respectively located on the end side of the ink head units 30*a* and 30*b*. The guide members 50 and 60 provided on the plate-like members 46 and 56 are respectively located on the end side of the caps 48 and 58.

In the above-described embodiment, the ink head unit 30*a* is provided on a left rear portion of the carriage 26, and the ink head unit 30*b* is provided on a right front portion of the carriage 26. In the cap device 32, the cap section 42 is provided on the left rear portion of the base member 40, and the cap section 44 is provided on a right front portion of the base member 40. The present invention is not limited to having such a structure.

For example, in the case where the ink head unit 30*a* is provided on a left front portion of the carriage 26 and the ink head unit 30*b* is provided on a right rear portion of the carriage 26, the cap section 42 may be provided on a left front portion of the base member 40 in the cap device 32 and the cap section 44 may be provided on a right rear portion of the base member 40.

Namely, on the base member 40 in the cap device 32, the cap section 42 is positioned such that when the base member 40 is raised, the cap 48 can form a hermetically closed space in a prescribed area of the bottom surface 30*aa* of the ink head unit 30*a*. The cap section 44 is positioned such that when the base member 40 is raised, the cap 58 can form a hermetically closed space in a prescribed area of the bottom surface 30*ba* of the ink head unit 30*b*.

In the above-described embodiment, the pairs of guide members 51 and 61 are provided to the rear of the caps 48 and 58 respectively. The pairs of guide members 51 and 61 determine the positions of the caps 48 and 58 in the sub scanning direction X. The present invention is not limited to having such a structure. For determining the positions of the caps 48 and 58 in the sub scanning direction X, a conventionally known technique, for example, the technique disclosed in Japanese Laid-Open Patent Publication No. 2000-255075 may be used.

The above-described embodiments may be combined appropriately.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing embodiments of the principle of the present invention. These embodiments are provided with the understanding that they are not intended to limit the present invention to the preferred embodiments described in the specification and/or shown in the drawings. The present invention is not limited to the embodiment described herein. The present invention encompasses any of embodiments including equivalent elements, modifications, deletions combinations, improvements and/or alterations which can be recognized by a person of ordinary skill in the art based on the disclosure. The elements of each claim should be interpreted broadly based on the terms used in the claim, and should not be limited to any of the embodiments described in this specification or used during the prosecution of the present application.

What is claimed is:

1. A cap device provided in an inkjet printer, the inkjet printer including a carriage movable in a main scanning direction between a printing position and a wait position; a first ink head unit having a bottom surface on which an inkjet nozzle is provided, the first ink head unit being mounted on the carriage; and a second ink head unit having a bottom surface on which an inkjet nozzle is provided, the second ink head unit being mounted on the carriage;

the cap device comprising:

a base member;

a first table provided so as not to be movable in the main scanning direction with respect to the base member;

a first cap provided on the first table, the first cap being closely contactable with the bottom surface of the first ink head unit by being raised;

a first guide member which has a first contact surface directed in a second direction, and is provided on the first table, where a direction in the main scanning direction that approaches the wait position is a first direction and a direction in the main scanning direction that is distanced from the wait position is the second direction;

a second table provided so as to be movable in the main scanning direction with respect to the base member;

a second cap provided on the second table, the second cap being closely contactable with the bottom surface of the second ink head unit by being raised;

a second guide member which has a second contact surface located on the side of the first direction with respect to the first contact surface and directed in the second direction, and is provided on the second table;

a third guide member which has a third contact surface facing the first contact surface, is provided on the first ink head unit, and protrudes downward from the carriage; and a fourth guide member which has a fourth contact surface located on the side of the first direction with respect to the third contact surface and facing the second contact surface, is provided on the second ink head unit, and protrudes downward from the carriage;

wherein the first, second, third and fourth guide members are arranged such that when the carriage moves in the first direction, the second contact surface and the fourth contact surface contact each other and after this, the first contact surface and the third contact surface contact each other.

2. A cap device according to claim 1, wherein the second table is located at a reference position at which, when the second contact surface and the fourth contact surface are not in contact with each other and the first contact surface and the third contact surface are not in contact with each other, a distance in the main scanning direction from the center of the first cap to the center of the second cap is shorter than a distance in the main scanning direction from the center of an area of the first ink head unit that is to be covered with the first cap to the center of an area of the second ink head unit that is to be covered with the second cap.

3. A cap device according to claim 2, further comprising a spring connected to the base member and the second table, the spring supplying the second table with a force for urging the second table toward the reference position.

4. A cap device according to claim 1, wherein the second table is structured so as to be movable in a sub scanning direction perpendicular to the main scanning direction.

5. A cap device according to claim 4, wherein the fourth guide member includes a guide surface inclining rearward and in the first direction from a rear end of the fourth contact surface, or a guide surface inclining forward and in the first direction from a front end of the fourth contact surface.

6. A cap device according to claim 1, further comprising:

a base support member located below the base member;

a support member having a top end portion pivotably supported by the base member and a bottom end portion pivotably supported by the base support member, the top end portion being located vertically above the bottom end portion, or on the side of the second direction with respect to the bottom end portion; and a spring connected to the base support member and the base member, the spring supplying the base member with a force for urging the base member in the second direction.

7. A cap device according to claim 1, wherein the third guide member is provided on the side of the second direction with respect to the first ink head unit, and the fourth guide member is provided on the side of the second direction with respect to the second ink head unit.

8. An inkjet printer, comprising a cap device according to claim 1.

* * * * *